US011319701B2

(12) United States Patent
Panseri

(10) Patent No.: US 11,319,701 B2
(45) Date of Patent: May 3, 2022

(54) SELF-CLEANING TOILET, PARTICULARLY FOR USE AS A URINAL

(71) Applicant: DESPE S.P.A., Torre De' Roveri (IT)

(72) Inventor: Roberto Panseri, Torre De' Roveri (IT)

(73) Assignee: DESPE S.P.A., Torre De'Roveri (IT)

( * ) Notice: Subject to any disclaimer, the term of this patent is extended or adjusted under 35 U.S.C. 154(b) by 0 days.

(21) Appl. No.: 17/259,422

(22) PCT Filed: Jul. 11, 2019

(86) PCT No.: PCT/IB2019/055921

§ 371 (c)(1),
(2) Date: Jan. 11, 2021

(87) PCT Pub. No.: WO2020/012405

PCT Pub. Date: Jan. 16, 2020

(65) Prior Publication Data

US 2021/0262216 A1 Aug. 26, 2021

(30) Foreign Application Priority Data

Jul. 11, 2018 (IT) ..... 102018000007107

(51) Int. Cl.
*E03D 13/00* (2006.01)
*E03D 9/00* (2006.01)

(52) U.S. Cl.
CPC ..... *E03D 13/005* (2013.01); *E03D 9/002* (2013.01)

(58) Field of Classification Search
CPC ..... E03D 13/005; E03D 11/11; E03D 9/002
See application file for complete search history.

(56) References Cited

U.S. PATENT DOCUMENTS 645,686 A 3/1900 Johnson
2,116,529 A 5/1938 McNeil
(Continued)

FOREIGN PATENT DOCUMENTS

FR 3015991 A1 7/2015
JP 2007046438 A 2/2007

OTHER PUBLICATIONS

International Search Report, issued in PCT/IB2019/055921, dated Sep. 25, 2019, Rijswijk, Netherlands.
(Continued)

*Primary Examiner* — Janie M Loeppke
(74) *Attorney, Agent, or Firm* — Ferguson Case Orr Paterson

(57) ABSTRACT

A self-cleaning toilet has a lower cup-shaped body delimiting an emptying opening connected to a draining pipe, and a filling opening, opposite to the emptying opening and facing a user of the self-cleaning toilet. The lower cup-shaped body has at least one side wall delimiting, with an upper edge thereof, at least one portion of the filling opening, and delimiting at least partially a gap interposed between an inner surface and an outer surface, the gap forming, with the at least one side wall a first basin adapted to contain a volume of fluid. The first basin leads to both the inner surface and the outer surface and is connected to a fluid supply duct adapted to convey a volume of cleaning fluid into the first basin so that when the cleaning fluid received in the first basin overflows, it cleans both the inner and outer surfaces.

19 Claims, 7 Drawing Sheets

(56) References Cited

U.S. PATENT DOCUMENTS 3,585,649 A * 6/1971 Miya ..... E03D 5/00
4/300
3,772,711 A * 11/1973 Spector ..... E03D 11/11
4/315
5,566,401 A * 10/1996 Kishi ..... E03D 11/00
4/300

OTHER PUBLICATIONS

Written Opinion, issued in PCT/IB2019/055921, dated Sep. 25, 2019, Rijswijk, Netherlands.

* cited by examiner

SELF-CLEANING TOILET, PARTICULARLY FOR USE AS A URINAL

CROSS-REFERENCE TO RELATED APPLICATIONS

This application is a National Phase Application of PCT International Application No. PCT/IB2019/055921, having an International Filing Date of Jul. 11, 2019 which claims the benefit of priority to Italian Patent Application No. 102018000007107, filed Jul. 11, 2018, each of which is hereby incorporated by reference in its entirety.

FIELD OF THE INVENTION

The object of the present invention is a toilet.

The present invention in particular relates to a self-cleaning toilet.

A toilet according to the present invention is particularly adapted, but not univocally intended, to be used as a men's urinal.

BACKGROUND OF THE INVENTION

Various solutions are generally known of toilets which comprise devices adapted to sanitize certain parts of the toilet intended to come into contact with a user. The sanitization of the toilet becomes crucial for protecting the public health and avoiding the spreading of bacteria, particularly when the toilet is not intended for private household use but is conceived to serve a multitude of various individuals, such as by way of non-limiting example, workers and/or commuters and/or travelers, and is installed in a public washroom.

For example, French Patent Application FR-3015991 shows a solution of a toilet comprising a cup-shaped body, in which there is provided the generation of a water blade which forms a kind of water shield which prevents liquids inside the toilet bowl from accidentally coming out.

For example, it is known from document US-645686 to make a toilet having a cup-shaped body and which comprises a basin for collecting a fluid intended to clean the user of the toilet, the basin being arranged beside the access opening to the bowl.

However, these solutions are not completely without drawbacks and in any case are inadequate for providing a satisfactory cleaning of the interior of the cup-shaped toilet. Solutions of toilets have also been proposed which provide cleaning flows under specific conditions of use. For example, Japanese Patent Application published under number JP-2007-046438 shows a solution of cup-shaped toilet comprising a hinged cover. When closed on the toilet bowl, the hinged cover forms an airtight chamber therewith so that the interior of the bowl is cleaned due to nozzles provided on the inner face of the hinged cover adapted to spray cleaning fluid.

Although it is advantageous from certain viewpoints, this type of solution imposes making a hinged cover of the bowl adapted to close the bowl itself in an airtight manner, necessarily requiring exceptional manufacturing tolerances. Moreover, the self-cleaning of the toilet in a similar solution requires some time, thus being inadequate for frequent repeated use.

The need is therefore strongly felt to provide a solution of a self-cleaning toilet which is particularly suitable for a frequent and repeated use, and simultaneously is adapted to provide an improved self-cleaning effect.

The need is also felt to provide a solution of a self-cleaning toilet capable of ensuring a sufficient hygiene for certain parts of the toilet intended to also inadvertently come into contact with a user.

SUMMARY OF THE INVENTION

It is an object of the present invention to obviate the drawbacks of the prior art and to provide a solution to the needs of providing a solution of a self-cleaning toilet adapted to frequent use and at the same time, adapted to providing an improved sanitization of the surfaces of the toilet with respect to known solutions.

These and other objects are achieved by a self-cleaning toilet and an assembly of modular units for public washroom as described and claimed herein.

Advantageous embodiments are also described.

According to one aspect of the invention, a self-cleaning toilet comprises at least one lower cup-shaped body, having substantially cup- or bowl-shaped body, which delimits at least one emptying opening adapted to be connected with a draining pipe of the self-cleaning toilet, and at least one filling opening, opposite to said emptying opening and adapted to face a user of the self-cleaning toilet. Said lower cup-shaped body comprises a side wall which delimits, with an upper edge thereof, at least one portion of said filling opening. Said at least one side wall comprises an inner surface and an outer surface which is opposite to said inner surface with respect to said side wall. Said at least one side wall at least partially delimits a gap interposed between said inner surface and outer surface, said gap forming at least a first basin adapted to contain a volume of fluid. Said first basin leads to both said inner surface and said outer surface by means of at least one discharge mouth. Said first basin is connected to an opening of a fluid supply duct adapted to convey a volume of cleaning fluid into said first basin so that when the cleaning fluid received in said first basin overflows, it cleans both said inner surface and said outer surface of the lower cup-shaped body.

The self-cleaning toilet further comprises at least a second basin preferably comprising at least one filing opening of second basin facing said outer surface of the side wall of the lower cup-shaped body, said outer surface leading to said at least one filling opening of second basin so that said second basin can be supplied with the cleaning fluid which overflowed from said first basin and which already wet said outer surface.

An improved level of sanitization for one or more toilets is provided due to the solutions proposed.

Both the inner surface and the outer surface of a toilet bowl can be sanitized due to the solutions proposed.

The cleaning of the toilet is automated due to the solutions proposed.

A self-cleaning toilet with improved hygiene adapted to be used as men's urinal, for example in installation in public washrooms, is provided due to the solutions proposed.

BRIEF DESCRIPTION OF THE DRAWINGS

Further features and advantages of the toilet will be apparent from the description provided below of preferred embodiments thereof, given by way of non-limiting examples, with reference to the accompanying drawings, in which.

DETAILED DESCRIPTION

Figure 1:
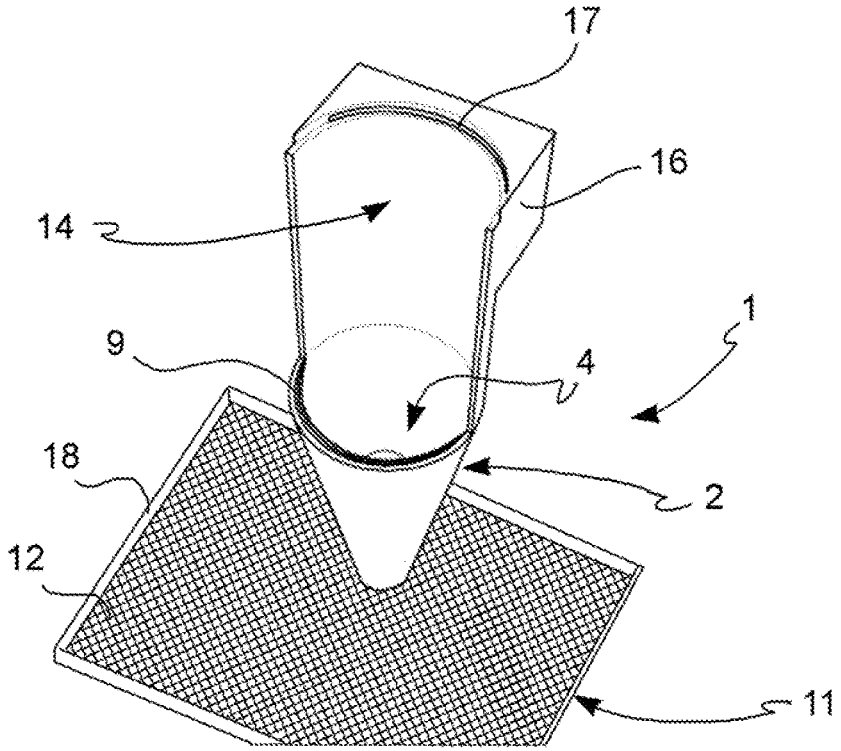
FIG. 1 is a front and top axonometric view of a self-cleaning toilet according to one embodiment.
Figure 2:
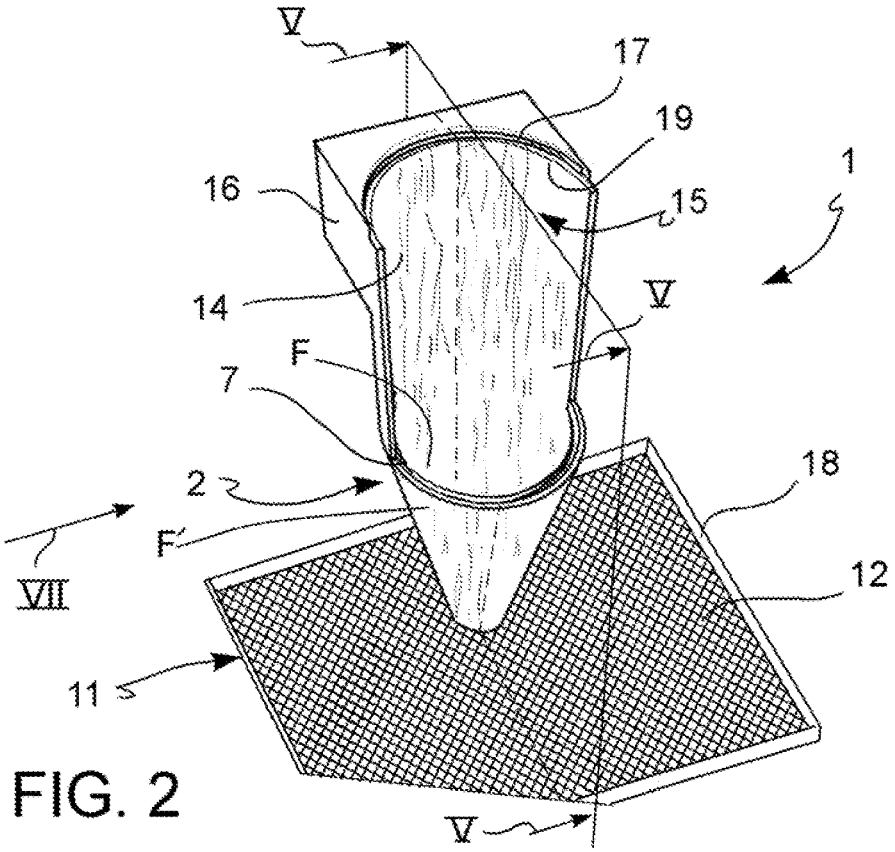
FIG. 2 is a front and top axonometric view of a self-cleaning toilet according to one embodiment.
Figure 3:
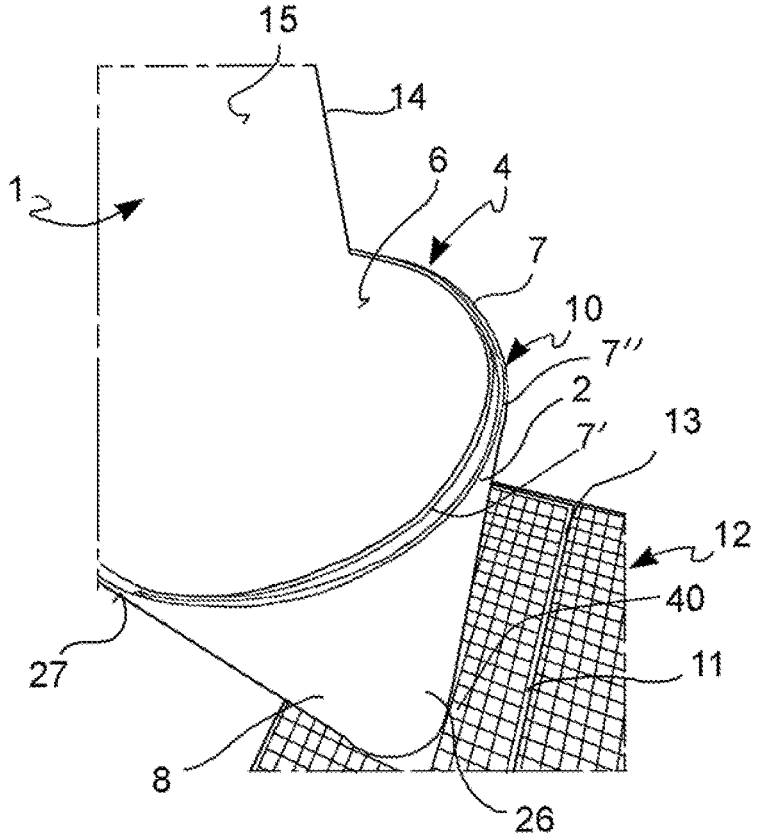
FIG. 3 is an axonometric view of a portion of a self-cleaning toilet according to one embodiment, which shows the upper edge of the front portion of the lower cup-shaped portion.
Figure 4:
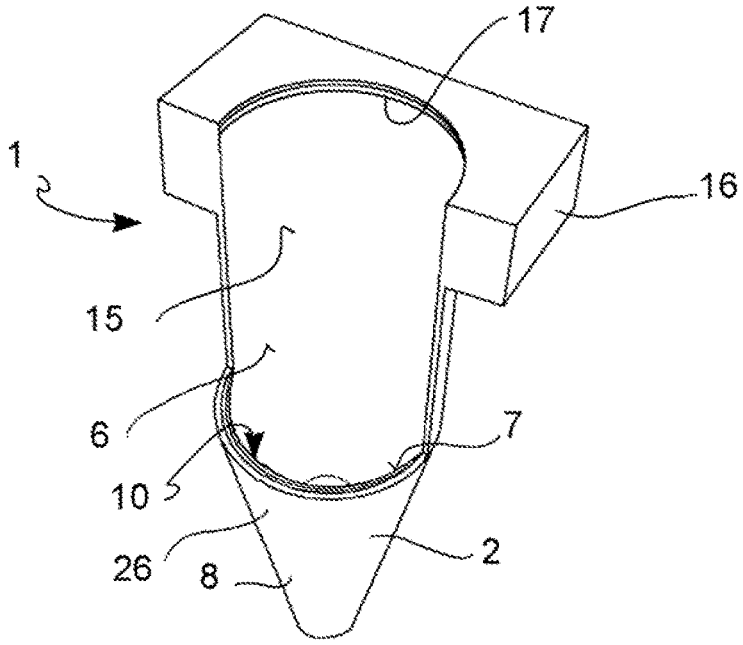
FIG. 4 is a front and top axonometric view of a self-cleaning toilet according to one embodiment.
Figure 5:
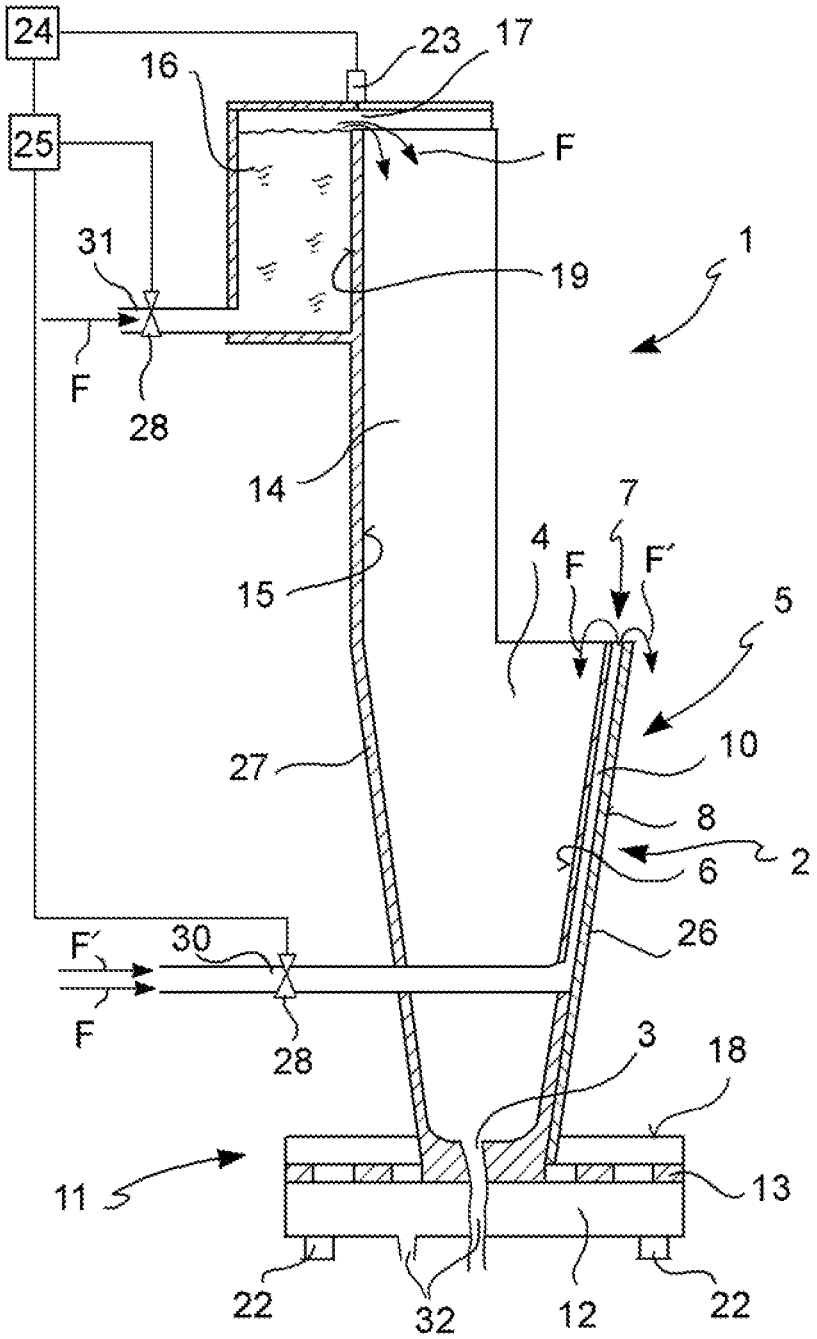
FIG. 5 is a schematized sectional view of a self-cleaning toilet according to one embodiment, which cross section is obtained according to the cutting plane indicated with the arrows V-V in FIG. 2.
Figure 6:
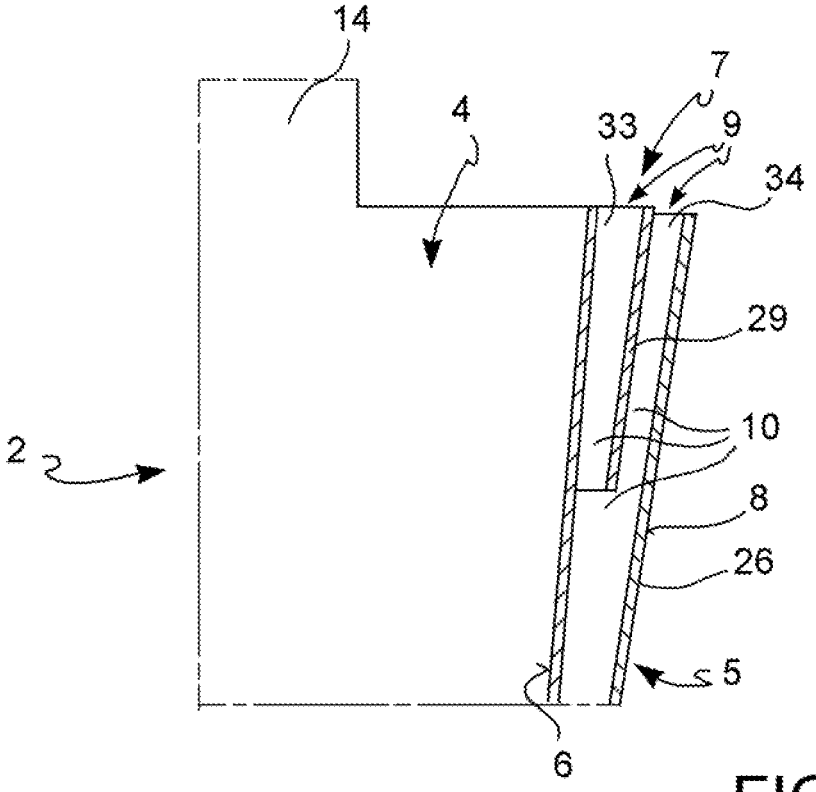
FIG. 6 is a sectional view of a detail of the side wall of a self-cleaning toilet according to one embodiment.
Figure 7:
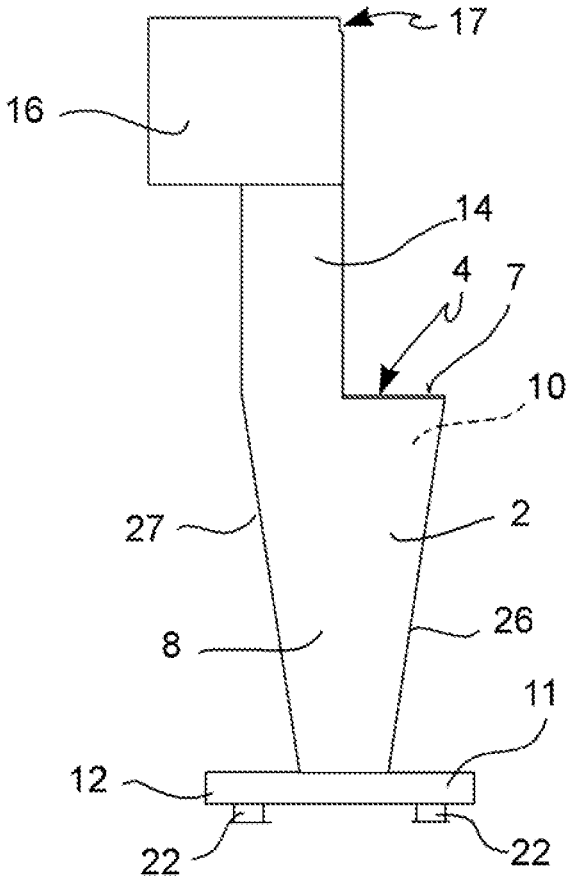
FIG. 7 is a vertical raised view of the self-cleaning toilet shown in FIG. 2, according to the view indicated by arrow VII in FIG. 2.
Figure 8:
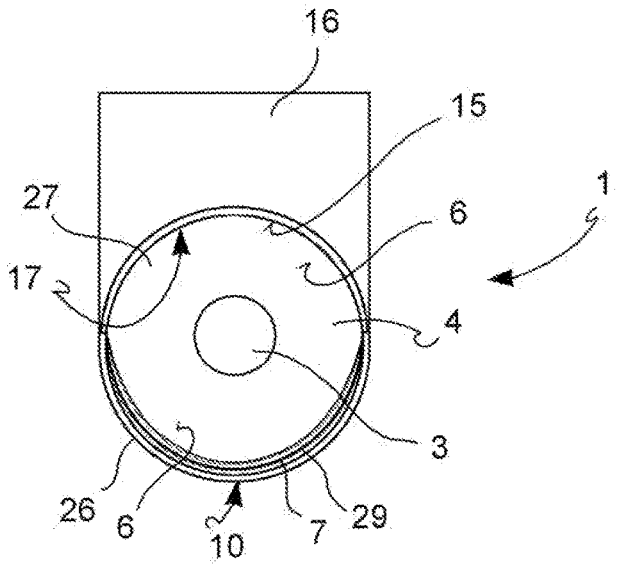
FIG. 8 is a top view of the self-cleaning toilet shown in FIG. 6, in which the box-like support is not shown for clarity.
Figure 9:
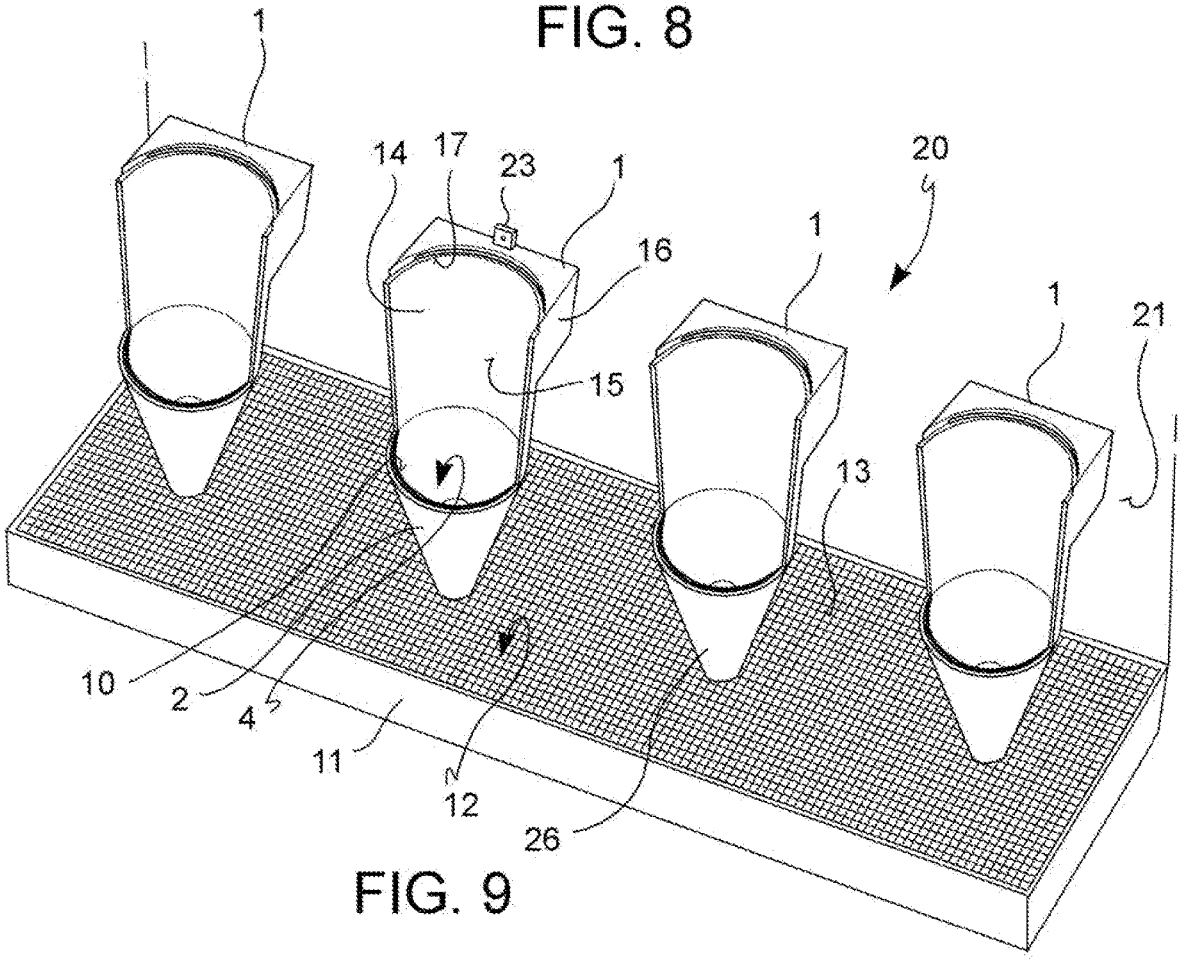
FIG. 9 is an axonometric view of an assembly according to one embodiment.
Figure 10:
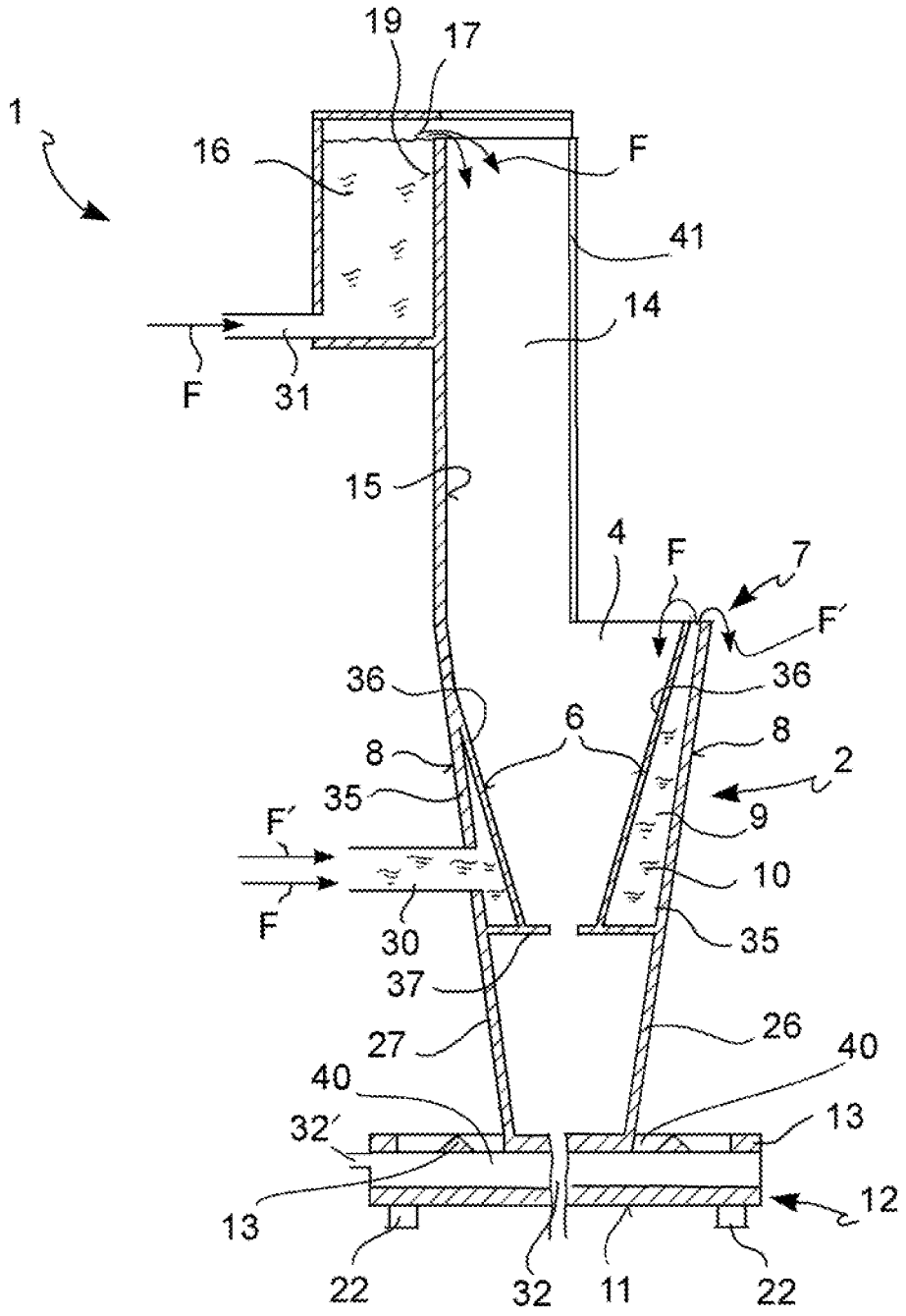
FIG. 10 is a schematized sectional view of a self-cleaning toilet according to one embodiment, which cross section is obtained according to the cutting plane indicated with the arrows V-V in FIG. 2.
Figure 11:
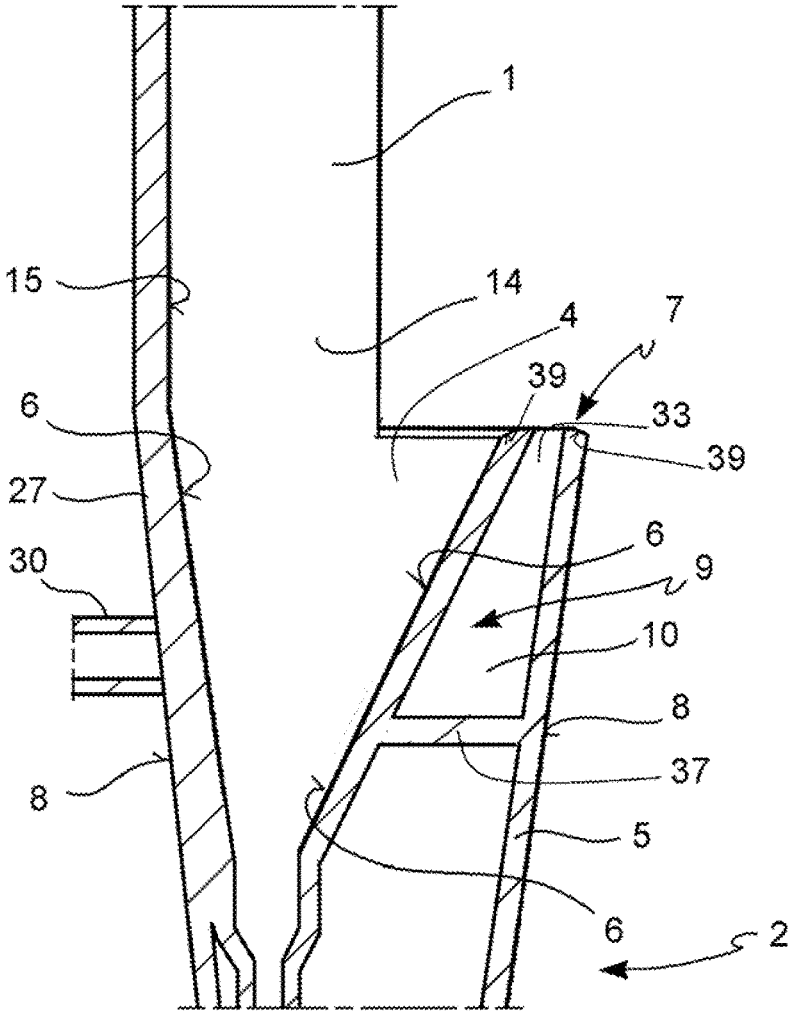
FIG. 11 is a sectional view of a portion of a self-cleaning toilet according to one embodiment, which cross section is obtained according to a cutting plane indicated with the arrows V-V in FIG. 2.

According to a general embodiment, a self-cleaning toilet 1 is provided.

A self-cleaning toilet 1 according to the present invention is particularly adapted, but not uniquely intended, to be used as men's self-cleaning urinal 1. According to a preferred embodiment, said self-cleaning toilet 1 is a men's urinal.

Said self-cleaning toilet 1 comprises at least one lower cup-shaped body 2. Said lower cup-shaped body 2 preferably is substantially cup- or bowl-shaped. Said lower cup-shaped body 2 preferably forms the bowl of the self-cleaning toilet 1.

According to a preferred embodiment, said lower cup-shaped body 2 delimits at least one emptying opening 3 adapted to be connected with a draining pipe 32 of the self-cleaning toilet 1, and at least one filling opening 4, opposite to said emptying opening 3 and adapted to face a user of the self-cleaning toilet 1. Said at least one filling opening 4 preferably substantially is circular. For example, said lower cup-shaped body 2 comprises a plurality of emptying openings 3. The at least one emptying opening 3 of the lower cup-shaped body 2 may be made on the bottom of the lower cup-shaped body 2.

Said lower cup-shaped body 2 comprises at least one side wall 5 which delimits, with an upper edge thereof 7, at least one portion of said filling opening 4.

Said at least one side wall 5 of the cup-shaped body 2 comprises an inner surface 6 which extends between said upper edge 7 and said at least one emptying opening 3 of the lower cup-shaped body 2. Thereby, said inner surface 6 leads to said emptying opening 3 of the lower cup-shaped body 2. According to one embodiment, said inner surface 6 delimits said at least one emptying opening 3 of the lower cup-shaped body 2.

Said at least one side wall 5 further comprises an outer surface 8 which is opposite to said inner surface 6 with respect to said side wall 5. Thereby, the upper edge 7 of the side wall 5 is formed by a portion of said inner wall 6 and by a facing portion of said outer wall 8.

Said at least one side wall 5 at least partially delimits a gap 9 interposed between said inner surface 6 and outer surface 8, the gap forming, with said at least one side wall 5, at least a first basin 10, or first tank 10, adapted to contain a volume of cleaning fluid F, F'. Thereby, said side surface 5 of the lower cup-shaped body 2 contains said first basin 10 in the volume thereof. The term 'basin' preferably means a container adapted to contain fluid, which not necessarily although preferably is open, so as to allow the fluid to overflow from the basin. The term "basin" preferably means a vessel adapted to contain a fluid and adapted to allow the fluid to overflow from the basin, and comprising at least one side wall and at least one bottom, in which the bottom may also be formed by said same side wall.

Said first basin 10 advantageously leads to both said inner surface 6 and said outer surface 8.

In other words, said side wall 5 forms a gap 9 therein which is delimited by, and leads to, both said inner surface 6 and said outer surface 8 of the lower cup-shaped body 2. Said upper edge 7 of the side wall 5 of the lower cup-shaped body 2 delimits a cleaning opening 33, or discharge mouth 33, due to the provision of such a gap 9 forming said first basin 10.

Further advantageously, said first basin 10 is connected to an opening of a fluid supply duct 30 adapted to convey a volume of cleaning fluid F. F' into said first basin 10 so that when the volume of cleaning fluid F, F' in said first basin 10 overflows, it cleans both said inner surface 6 and said outer surface 8 of the lower cup-shaped body 2. In other words, said first basin 10 is connectable to said fluid supply duct 30.

The term "overflows" also means "spills over".

According to one embodiment, the supply duct 30 is connected to a water supply network or the like so as to supply said first basin 10 with cleaning fluid F, F'. Thereby, flows of cleaning fluid F, which preferably is an aqueous solution containing ozone, are generated both on said inner surface 6 and on said outer surface 8 of the lower cup-shaped body 2 of the self-cleaning toilet 1. A device for pumping the cleaning fluid F. F' preferably is provided. For example, the ozone dispersed in the cleaning fluid F. F' is sucked by said pumping device, thus mixing with the water of the cleaning fluid F, F'. An ozone detector for detecting possible leaks may be provided on the exterior of toilet 1.

According to one embodiment, said first basin 10 is connected to a fluid supply duct 30 adapted to be connected to a water distribution network. Thereby, an improved hygiene for a user of the toilet is allowed, without however requiring the intervention of an operator, not even for cleaning the outer surface 8 of the lower cup-shaped body 2. The flow of cleaning fluid F, F' which crosses said fluid supply duct 30 fills said first basin 10 and overflowing therefrom, forms both a flow of cleaning fluid F for cleaning the inner surface and a flow of cleaning fluid F' for cleaning the outer surface. The flow of cleaning fluid F. F' which crosses said fluid supply duct 30 preferably is a single flow in which the flows of cleaning fluid F, F' for cleaning the inner surface and for cleaning the outer surface, respectively, are indistinguishable.

When under operating conditions, the cleaning fluid F, F' crosses the supply duct 30, reaches the first basin 10 formed by said gap 9, thus filling it with fluid and accordingly raising the level of the cleaning fluid F, F' therein. When the level of cleaning fluid F, F' in basin 10 reaches the upper edge 7, it overflows, passing through at least one discharge mouth 33, cleaning both the inner surface 6 and the outer surface 8 of the lower cup-shaped body 2. According to one embodiment, said at least one discharge mouth 33 leads to both said outer surface 8 and said inner surface 6 of the lower cup-shaped body 2.

Due to the provision of such a first basin 10 which leads from the upper edge 7 of the side wall 5 of said cup-shaped portion 2, both the interior and the exterior of the cup-shaped portion 2 may be cleaned due to the effect of gravity.

According to one embodiment, the outer surface 8 and the inner surface 6 of the side wall 5 each have an upper surface edge 7', 7", and the upper surface edges 7' and 7" of both said inner 6 and outer 8 surface act in conjunction, thus forming the upper edge 7 of the side wall 5, thus delimiting said at least one discharge mouth 33.

The upper inner surface edge 7' is not necessarily at the same height as the upper outer surface edge 7", although according to a preferred embodiment, they substantially are at the same height. The difference in level between said upper inner surface edge 7' and said upper outer surface edge 7" may be selected so as to control the flow rate of the respective flows of cleaning fluid F overflowing from said first basin 10. According to one embodiment, the upper outer surface edge 7" is arranged lower than the upper inner surface edge 7'.

According to a preferred embodiment, at least one of said upper inner surface edge 7' and said upper outer surface edge 7" comprises at least one bevel 39 with slope facing towards said inner surface 6 and said outer surface 8, respectively.

According to one embodiment, said first basin 10 has the shape of a half-moon defined by said gap 9 of said lower cup-shaped body 2 of the self-cleaning toilet 1.

According to one embodiment, said first basin 10 has the shape of at least one ring portion at least partially surrounding the inner surface 6 of the lower cup-shaped body 2.

According to a preferred embodiment, the side wall 5 of said cup-shaped body 2 comprises two cup-shaped shells 35, 36 fitted onto each other so that a first cup-shaped shell 36 forms the inner surface 6 and a second cup-shaped shell 35 forms the outer surface 8, and so that said at least one gap 9 which forms said at least a first basin 10 is interposed between said first cup-shaped shell 36 and said second cup-shaped shell 35, said gap being adapted to contain a volume of cleaning fluid F, F'.

According to one embodiment, said gap 9 forms said at least one discharge mouth 33 for the cleaning fluid F, F' of the first basin 10, close to the upper edge 7.

According to a preferred embodiment, said self-cleaning toilet 1 comprises a single discharge mouth 33 exiting from the first basin 10 for cleaning the inner 6 and outer 8 surfaces of the lower cup-shaped body 2 of the self-cleaning toilet 1. Thereby, the possibility is provided of a simplified control of the outlet pressures of the cleaning fluid F, F'. The finishing of the upper edge 7 of the side wall 5 may be sized so as to guide the cleaning flow F, F' exiting from the at least one discharge mouth 33 towards the inner wall 6 and/or towards the outer wall 8.

According to one embodiment, the at least one discharge mouth 33 of said first basin 10 is wedge-shaped. According to one embodiment, the at least one discharge mouth 33 of said first basin 10 is half-moon shaped. According to one embodiment, the at least one discharge mouth 33 of said first basin 10 has the shape of at least one ring portion delimited by a front portion, i.e. which can frontally face a user of the self-cleaning toilet 1, of the upper edge 7 of said side wall 5.

According to one embodiment, the at least one discharge mouth 33 of said first basin 10 substantially is annular-shaped like an annular slit.

According to one embodiment, said cup-shaped body 2 comprises a bottom wall 37, e.g. a transverse wall 37, which preferably extends transversely to the inner surface 6 of the cup-shaped body 2 and forms the bottom of said first basin 10. For example, said bottom wall 37 is connected, e.g. welded, to both said inner surface 6 and said outer surface 8. According to one embodiment, said transverse wall 37 delimits an emptying hole in fluid communication with said emptying opening 3 of the cup-shaped body 2.

According to one embodiment, said cup-shaped body 2 is formed by at least one shaped sheet, which is rolled and welded into edge portions thereof to form a cup-shaped body, e.g. frustoconical shaped. According to one embodiment, the outer wall 5 of said cup-shaped body 2 is formed by at least two shaped sheets, which are rolled and welded in respective edge portions thereof to form at least two cup-shaped shells, e.g. frustoconical shaped, thus interposing a gap between said two cup-shaped shells so as to form said at least a first basin 10.

According to a preferred embodiment, said cup-shaped body 2 has a downwards tapered shape.

According to one embodiment, said cup-shaped body 2 has a downwards frustoconical shape.

Due to the provision of a downwards tapered cup-shaped body 2, it allows a user of the self-cleaning toilet 1 frontally approaching the lower cup-shaped body to position his feet substantially under the upper edge 7, without imposing contact with the outer surface 8 of the side wall 5.

Said side wall 5 preferably is substantially frustoconical shaped. Said side wall 5 preferably has a downwards tapered shape. According to one embodiment, said filling opening 4 has a larger perimeter than said emptying opening 3 and both are delimited by said inner surface 6 of the side wall 5 of the lower cup-shaped body 2.

According to one embodiment, said side wall 5 of the lower cup-shaped body 2 substantially is frustoconical shaped, in which said inner surface 6 and said outer surface 8 of the side wall 5 are not parallel to each other. Thereby, an angle is defined between said inner surface 6 and said outer surface 8. The provision of said non-parallel inner surface 6 and said outer surface 8 of the frustoconical side wall 5 causes the cleaning fluid F and F' to wet two inclined surfaces formed by the inner 6 and outer 8 surfaces, respectively, having different slope. Thereby, a difference in speed may be caused of the cleaning fluid F. F' which wets the inner surface 6 and the one which wets the outer surface 8. The inclination of the outer surface 8 of the lower cup-shaped body 2 is selected so that the cleaning fluid F' which wets it by overflowing from said discharge mouth 33 remains adhering to the outer surface 8, thus avoiding the formation of drops.

According to one embodiment, a control and operating device is provided, comprising at least one presence sensor 23, a data processing unit 24 and at least one operating device 25, in which said presence sensor 23 is adapted to detect information on the presence or absence of a user of the self-cleaning toilet 1 and to transfer said detected information to said data processing unit 24, and in which said data processing unit 24 acts in conjunction with said operating device 25 to allow the cleaning fluid F. F' to flow from the supply duct 30 to the first basin 10, thus filling it. For example, said supply duct 30 comprises a valve 28, for example a valve which is normally closed, for example a solenoid valve, controlled by the operating device 25. Said presence sensor 23 preferably comprises a photocell.

The cleaning of the self-cleaning toilet 1 may be automated due to the provision of such a control device 24.

According to one embodiment, said control device comprises at least one further sensor adapted to detect the level of cleaning fluid F, F' in said first basin 10.

According to one embodiment, said cup-shaped portion 2 is cylindrical shaped.

According to one embodiment, said side wall 5 comprises a partition septum 29 interposed between the outer surface 8 and the inner surface 6 of the side wall 5 of the lower cup-shaped body 2, said septum 29 acting as divide for the cleaning fluid F, F' overflowing from said first basin 10. Thereby, said septum 29 defines two outlet mouths 33, 34, or discharge mouths 33, 34, of the cleaning fluid F, F' from the first basin 10. According to one embodiment, a first outlet mouth 33 partially delimited by said septum 29 is adapted to bring the cleaning fluid F overflowing from the first basin 10 onto said inner surface 6. According to one embodiment, a second outlet mouth 34 partially delimited by said septum 29 is adapted to bring the cleaning fluid F' overflowing from the first basin 10 onto said outer surface 8.

According to one embodiment, said septum 29 is an arched foil. Said septum 29 preferably is obtained from a shaped sheet welded in the edge portions thereof to said cup-shaped body 2, preferably at the walls of the cup-shaped body 2 which delimit said gap 9 which forms the first basin 10. According to one embodiment, said septum 29 delimits said two outlet mouths 33, 34 in which the first outlet mouth 33 is radially inwards with respect to the second outlet mouth 34, in which the term "radially inwards" means the position with respect to a definable radial radius of the cup-shaped portion 2, preferably a frustoconical cup-shaped portion 2. Said septum 29 which acts as divide preferably is arranged on the upper edge 7 of the cup-shaped body 2.

According to one embodiment, said septum 29 divides said at least one gap 9 into at least two gaps, said at least two gaps may be mutually communicating, thus forming a single first basin 10, or they may be isolated from each other to each form a first basin 10. Thereby, said side wall 5 comprises at least two first basins 10. According to one embodiment, said side wall 5 delimits at least two substantially concentric gaps 9.

Two outlet mouths 33, 34 may be made due to the provision of said septum 29, one which leads to the outer surface 8 of the cup-shaped body 2 and the other to the inner surface 6 of the cup-shaped body 2.

According to a preferred embodiment, said self-cleaning toilet 1 comprises at least a second basin 12, or second tank 12, which is supplied by the cleaning fluid F' which overflowed from said first basin 10 and which already cleaned said outer surface 8 of the side wall 5 of the lower cup-shaped body 2. Thereby, said second basin 12 is adapted to collect the cleaning fluid F' which already cleaned said outer surface 8 of the side wall 5 of the self-cleaning toilet 1.

According to one embodiment, said second basin 12 is arranged at the bottom with respect to said outer surface 8 of the side wall 5. According to a preferred embodiment, said outer surface 8 of the side wall 5 extends between said upper edge 7 and said second basin 12.

According to a preferred embodiment, said second basin 12 comprises at least a second basin opening 40 facing said outer surface 8 of the side wall 5 of the lower cup-shaped body 2.

According to one embodiment, said at least a second basin opening 40 is at least partially delimited by said outer surface 8 of the side wall 5 of the lower cup-shaped body 2.

According to a preferred embodiment, said self-cleaning toilet 1 further comprises a box-like support 11 which supports said lower cup-shaped body 2 in position. Said box-like support 11 preferably has box-like shape which comprises said second basin 12, or second tank 12. A connection flange may be provided on the lower portion of the lower cup-shaped body 2 for the connection thereof to the box-like support 11. According to a preferred embodiment, said lower cup-shaped body 2 is fastened, e.g. welded, to said support 11.

According to a preferred embodiment, said box-like support 11 further comprises a cover grate 13 forming a floor surface which is over the second basin 12. Thereby, a user of the self-cleaning toilet 1 may rest or tread on said cover grate 13 in order to surmount said second basin 12, thus avoiding to be required to place his feet in the second basin 12 during the use of the self-cleaning toilet 1, e.g. a urinal. The section of the elements forming such a grate 13 may be tapered to minimize the contact surface with the soles of a user of toilet 1. According to a preferred embodiment, said support 11 is arranged under the cup-shaped body 2 so that the outer surface 8 of the side wall 5 of the lower cup-shaped body 2 leads into said second basin 12. Said second basin 12 preferably is supplied by the cleaning fluid F' overflowing from said first basin 10 and which cleans said outer surface 8 of the side wall 5 of the cup-shaped body 2. Said second basin opening 40 preferably is arranged under said outer surface 8 of the side wall 5 of the lower cup-shaped body 2 so that said second basin opening 40 is facing said outer surface 8 in vertical direction, i.e. direction of the force of gravity.

The cleaning fluid F' which wets the outer surface 8 may flow into the second basin 12 both by flowing over the outer surface 8 itself and by trickling or dripping vertically from the outer surface 8 into the second basin 12.

Due to the provision of such a second basin 12 arranged under said cup-shaped body 2, the cleaning fluid F' for cleaning the outer surface may be collected inside said second basin 12 after the cleaning of said outer surface 8 of the lower cup-shaped body 2.

The inclination of the outer surface 8 and also the surface finish of the outer surface 8 and also the flow rate of the cleaning fluid F' which cleans the outer surface 8 may be selected so as to allow the cleaning fluid F' which cleans the outer surface 8 to flow into the second basin opening 40.

Due to the provision of such a second basin 12 associated with said cover grate 13, when the cleaning fluid F' which cleans the outer surface 8 is collected in the second basin 12 and overflows, it wets the cover grate 13, sanitizing it. Thereby, the cleaning fluid F' which overflows from said at least one discharge mouth 33, wetting the outer surface 8, also cleans the cover grate 13 located under the lower cup-shaped body 2. Ozone may be provided in the second basin 12.

According to one embodiment, said second basin 12 is adapted to be connected with a draining pipe 32 of the self-cleaning toilet 1.

According to one embodiment, said second basin 12 is directly or indirectly connected to the drain 32, for example by interposing a stretch of outlet duct 32' of second basin associated with an overflow indicator.

According to one embodiment, said cover grate 13 is arranged at a lower level with respect to edge 18 of the second basin 12. In other words, the upper edge 18 of said second basin forms a side which exceeds the level of the cover grate 13. Thereby, when the cleaning fluid F' overflows from the second basin 12, it slightly submerges said cover grate 13, thus cleaning it. The height of said edge 18, or side, may be selected so that the difference in level between edge 18 and the cover grate 13 forming the floor surface is minimum so as to avoid submerging the shoes of a user of the toilet, while cleaning the sole thereof. Due to the provision of such a second basin 12 surmounted by a cover grate 13, the cleaning fluid F collected in the second basin 12 may overflow towards drain 32, submerging, cleaning the cover grate 13, in this manner also sanitizing a portion of the sole of a shoe of a user of the self-cleaning toilet 1.

The sizing of the crosswise or lengthwise elements of the grating of the cover grate 13 may be selected to absolve the function of supporting a user on said second basin 12 and simultaneously allow the cleaning fluid F' to flow into the second basin 12 after cleaning the outer surface 8.

When under operating conditions, the cleaning fluid F' which overflows from said first basin 10 cleans the outer surface 8 of the lower cup-shaped body 2 and accumulates in the second basin 12.

When the level of cleaning fluid F' in the second basin 12 exceeds a given height at which the cover grate 13 is arranged, said cover grate 13 preferably is cleaned by the raising of the level of cleaning fluid F' collected in the second basin 12. According to one embodiment, the second basin draining pipe of the second basin 12 and said emptying opening 3 of the self-cleaning toilet 1 both flow into the same drain 32, for example a same channeling of a sewer or urban draining system.

According to one embodiment, said second basin 12 overflows towards drain 32.

When the level of cleaning fluid F' in the second basin 12 exceeds the one of edge or side 18, preferably it overflows from the second basin 12 and goes into drain 32.

According to a preferred embodiment, said box-like support 11 comprises a tilt adjustment device 22 adapted to keep said second basin 12 substantially horizontal or level. Thereby, said tilt adjustment device 22 is adapted to also keep level said cup-shaped body 2 which is associated with said box-like support 11. According to one embodiment, said tilt adjustment device 22 is telescopically extendable and comprises a first body and a second body, in which said first body and said second body are fitted onto each other so as to be telescopically extendable. According to one embodiment, said tilt adjustment device 22 comprises at least one screw jack. According to one embodiment, said tilt adjustment device 22 comprises at least one pair of adjustable legs, preferably at least three independently adjustable legs.

According to one embodiment, said second basin 12 is provided with an overflow device, for example an overflow hole, arranged at a predetermined vertical distance from the cover grate 13 so as to allow the at least partial emptying of the second basin 12 when the cleaning fluid F' reaches a predefined level, thus occupying a predefined volume, in said second basin 12. According to one embodiment, said control device 24 is operatively connected to a sensor adapted to detect the level of cleaning fluid F' in said second basin 12 in order to verify the proper operation of the overflow element, so that the control device 24 transmits control signals to said at least one valve 28 so it closes. Thereby, under breakdown conditions, the self-cleaning toilet 1 may operate without the automatic cleaning of the outer surface 8 of the cup-shaped body 2.

Figure 12:
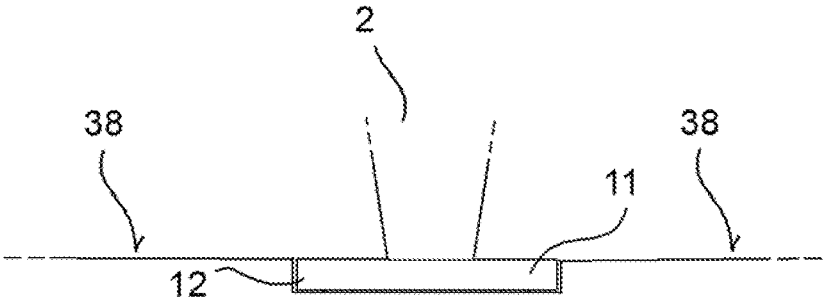
FIG. 12 is a schematized sectional view showing a portion of a self-cleaning toilet according to one embodiment, in which the second basin is shown embedded in a floor.

According to one embodiment shown for example in FIG. 12, said second basin 12 is adapted to be installed locally embedded in the floor, bringing said edge 18 or said grate 13 substantially locally flush with the floor level 38 so as to eliminate the presence, or at least minimize the entity, of a step for a user approaching the self-cleaning toilet 1. One or more fastening brackets may be provided for fastening the second basin 12 to the floor or to a floor slab.

According to a preferred embodiment, said self-cleaning toilet 1 further comprises an upper shield 14 comprising a containing wall 15 adapted to face a user of the self-cleaning toilet 1.

According to one embodiment, said containing wall 15 is substantially vertical oriented.

According to one embodiment, said self-cleaning toilet 1 further comprises a third basin 16, or third tank 16, adapted to receive cleaning fluid F for cleaning the inner surface. Said third basin 16 preferably is associated with said upper shield 15. According to one embodiment, said third basin 16 is supplied by a supply duct 31 which can be associated with the self-cleaning toilet 1. The flow of cleaning fluid F which crosses said supply duct 31 is collected in said third basin 16 and is intended for cleaning the inner surface 6 of the lower cup-shaped body 2. According to one embodiment, said supply duct 31 is associated with a valve 28 controlled by the control device. According to one embodiment, said third basin 16 is arranged at the top with respect to said upper shield 15. According to one embodiment, said third basin 16 is over said upper shield 15.

According to one embodiment, said third basin 16 delimits, with the walls thereof, a third basin opening 17 which leads to said containing wall 15. According to one embodiment, said at least a third basin opening 17 is at least partially delimited by said containing wall 15, and preferably by the upper edge 19 of the containing wall 15. According to one embodiment, said at least a third basin opening 17 is in the shape of a slit, preferably a curved slit, for example annular or semi-annular, adapted to frontally face a user of the self-cleaning toilet 1.

According to one embodiment, said at least a third basin opening 17 leads frontally flush with the containing wall 15 of the upper shield 14 so as to clean it due to the effect of gravity.

According to one embodiment, said third basin 16 is arranged behind the upper shield 14. Thereby, the third basin 16 may be frontally concealed from the sight of a user, when needed. According to one embodiment, said third basin 16 is frontally delimited by said upper shield 14. According to one embodiment, said third basin 16 has greater width than the upper shield 14. Thereby, a third basin opening 17 may be obtained, for example a slit, which extends for the whole extension of the containment surface 15, to clean it. Said third basin 16 for example, is in the shape of a box-like container in the shape of a parallelepiped which comprises two side extensions which extend outside of the upper shield 14.

According to one embodiment, said containing wall 15 is in the shape of a portion of cylindrical surface. For example, it is substantially vertically oriented. According to one embodiment, said containing wall 15 comprises an arched surface which forms a curved face facing a user of the toilet.

According to one embodiment, said containing wall 15 is adapted to convey the cleaning fluid F towards said lower cup-shaped body 2 of the self-cleaning toilet 1 to clean at least the inner surface 6 of the rear portion 27 of the side wall 5 of the lower cup-shaped body 2.

According to a preferred embodiment, said containing wall 15 comprises at least one containing edge 41 and preferably is delimited by a pair of containing edges 41 arranged at the ends thereof and facing it to form a barrier against the accidental cleaning of a user with the cleaning fluid F outlet from said third opening 17 for cleaning the upper shield 14.

According to one embodiment, said lower cup-shaped body 2 of the self-cleaning toilet 1 comprises a front portion 26, which can face a user of the self-cleaning toilet 1 when under operating conditions, and an opposed rear portion 27, opposite to said front portion 26 with respect to said filling opening of the lower cup-shaped body 2. According to one embodiment, said front portion 26 of the lower cup-shaped body 2 completely delimits said gap 9, forming said first basin 10 which leads from the upper edge 7 of the front portion 26 of the cup-shaped portion 2. Thereby, the upper edge 7 of the side wall 5 of the lower cup-shaped body 2 delimits said at least one discharge mouth 33 only on the front side of the cup-shaped body 2, thus avoiding to provide said at least one discharge mouth 33 in the rear portion 27. The term "front side" preferably means the side of the cup-shaped body which is approached by a user of the toilet under operating conditions.

According to one embodiment, the at least one discharge mouth 33 extends along the whole upper perimeter of the upper edge 7 of the side wall 5 of the front portion 26 of the lower cup-shaped body 2.

According to one embodiment, said rear portion 27 of the lower cup-shaped body 2 forms said upper shield 14 without a gap. In other words, the inner wall 6 of the rear portion 27 of the lower cup-shaped body 2 forms a single piece with, or is welded to, the containing wall 15 of the upper shield 14. Thereby, the cleaning of the rear portion 27 is obtained mainly due to the cleaning fluid F which overflows from the third basin 16 which, leading to the rear shield 14 by means of said third basin opening 17, cleans both the containment surface 15 of the upper shield 14 and the inner surface 6 of the rear portion 27 of the lower cup-shaped body 2 due to the effect of gravity. Simultaneously, the cleaning of both the inner 6 and outer 8 surfaces of the side wall 5 of the front portion 26 of the lower cup-shaped body 2 occurs due to the cleaning fluid F which overflows from said first basin 10.

According to one embodiment, said upper shield 14 is formed by a shaped sheet, which is rolled and preferably welded in edge portions thereof to said cup-shaped body 2.

According to one embodiment, said inner surface 6 is a single piece. In other words, the inner surface 6 of the rear portion 27 and the inner surface 6 of the front portion 26 of the side wall 5 of the cup-shaped portion 2 are two portions of the same surface. According to one embodiment, said inner surface 6 is a surface having cylindrical symmetry which extends about a substantially vertical symmetry axis. According to one embodiment, said inner surface 6 is a frustoconical surface.

According to one embodiment, said rear portion 27 of the lower cup-shaped body 2 does not have cleaning openings. According to one embodiment, said rear portion 27 forms a first cup-shaped half body of the lower cup-shaped body 2 and said front portion 26 forms a second cup-shaped half body of the lower cup-shaped body 2 so that said rear portion 27 and said front portion 26 jointly form the body of the cup-shaped portion of the toilet. A cleaning opening 33 preferably is arranged only on the front portion 26. The cleaning of the rear portion 27 preferably occurs due to the third basin opening 17 from which the cleaning fluid F overflows which cleans the upper shield 15 by gravity and then the inner surface 6 of the rear portion 27. According to one embodiment, cleaning the outer surface 8 of the side wall 5 of the rear portion 27 is avoided.

According to one embodiment, the shape of the inner surface 6 of the lower cup-shaped body 2 is selected so that it forms vorticities in the cleaning fluid F for cleaning the inner surface which overflows from said first basin 10 and/or from said third basin 16. Thereby, the self-cleaning efficiency of the self-cleaning toilet 1 is increased.

According to one embodiment, the inner surface 6 of the lower cup-shaped body 2 substantially is smooth to avoid stagnating areas.

According to one embodiment, said operating device 25 is adapted to selectively open both the supply duct 30 of the first basin 10 and the supply duct 31 of the third basin 16. Thereby, both the lower cup-shaped body 2 and the upper shield 15 are cleaned with a single command. According to one embodiment, said operating device 25 is controlled by a manually-operated control lever.

According to one embodiment, said self-cleaning toilet 1 comprises a tank of detergent containing ozone, in which said tank of detergent is in fluid connection both with said first basin 10 and with said second basin 16.

According to one embodiment, said self-cleaning toilet 1 is completely made of metal. According to one embodiment, said self-cleaning toilet is made of steel. According to one embodiment, said self-cleaning toilet 1 is made of metal, for example crude metal or satin metal. According to a preferred embodiment, said lower cup-shaped body 2 and/or said upper shield 14 of said self-cleaning toilet 1 is made of steel, preferably stainless steel, crude and/or satin stainless steel. The provision of said self-cleaning toilet 1 made of metal, e.g. steel, allows the material to be recycled, for example in a foundry.

According to one embodiment, said lower cup-shaped body 2 and/or said upper shield 14 are at least partially made of ceramic for toilets or the like. For example, said lower cup-shaped body 2 and/or said upper shield 14 are made of metal covered with ceramic for toilets.

According to one embodiment, said self-cleaning toilet 1 is resting on said box-like support 11.

According to one embodiment, said self-cleaning toilet comprises wall fastening means, for example threaded means, adapted to form a support connection between the self-cleaning toilet and a wall of a building 21.

According to a general embodiment, said self-cleaning toilet 1 according to any one of the embodiments described above forms a modular unit for public washrooms.

According to a general embodiment, an assembly 20 of modular units for public washrooms comprises a plurality of self-cleaning toilets 1 according to any one of the embodiments described above.

According to one embodiment, said assembly 20 comprises a single box-like support 11 with which a plurality of self-cleaning toilets 1 is associated. Said single box-like support 11 preferably forms a single second basin 12. Said single box-like support 11 may be mounted recessed in a floor.

A method for cleaning a toilet 1 is described below.

According to a general embodiment, a method for cleaning a toilet 1 comprises the step of causing the cleaning of both said inner surface 6 and said outer surface 8 of said lower cup-shaped body 2 by means of a single control.

Thereby, it is avoided for an operator to have to clean the surfaces 6 and 8 of the cup-shaped body 2.

According to a possible operating method, said step of causing the cleaning of both said inner surface 6 and said outer surface 8 of the side wall 5 of the lower cup-shaped body 2 is executed by providing a gap 9 in the side wall 5 which forms a first basin 10, or first tank 10, which leads to both said inner surface 6 and said outer surface 8 of the side wall 5. Said step of causing the cleaning of both said inner surface 6 and said outer surface 8 preferably is executed by providing a single discharge mouth 33 on the upper edge 7 of the side wall 5 of the lower cup-shaped body 2 which leads to both said inner surface 6 and said outer surface 8 of the lower cup-shaped body 2.

According to a possible operating method, the method comprises the step of flooding said first basin 10 with cleaning fluid F, F' so that it overflows.

According to a possible operating method, the method comprises the step of adjusting the related height of the upper surface edges 7' and 7" of the inner 6 and outer 8 surfaces of the side wall 5 of the lower cup-shaped body 2. Thereby, the flow rate of cleaning fluid F overflowing from said first basin 10 which cleans the inner surface 6 and the flow rate of cleaning fluid F' overflowing from said first basin 10 which cleans the outer surface 8, may be adjusted.

According to a possible operating method, the method comprises the step of adjusting the inclination of the outer surface 8 with respect to the vertical direction so that the cleaning fluid F' overflowing from said first basin 10 adheres, wetting it at the outer surface 8.

According to a possible operating method, the method comprises the step of providing a self-cleaning toilet 1 according to any one of the embodiments described above.

According to a possible operating method, the method comprises the further step of causing the cleaning also of said cover grate 13 of the second basin 12 arranged at the bottom with respect to the lower cup-shaped body 2.

According to a possible operating method, the method comprises the further step of causing the cleaning also of said containment surface 15 of the upper shield 14 by means of said single control.

According to a possible operating method, said single control is provided by a user of the toilet by means of the operation of a control lever or an operating button.

According to a possible operating method, said single control is provided by a control and operating device in response to information detected by at least one sensor 23.

The above-mentioned needs may be met due to the above-described features provided separately from or jointly with one another in particular embodiments, thus resulting in the above-mentioned advantages, and in particular

- a solution is provided of a toilet 1 capable of executing the cleaning of the inner and outer surfaces of said lower cup-shaped body 2 and thus it is avoided for an operator to perform the cleaning of the inner 6 and outer 8 surfaces of the lower cup-shaped body 2;
- a solution is simultaneously provided of a toilet capable of executing the cleaning of the containment surface arranged in front of a user, thus being particularly advantageous if the self-cleaning toilet is a self-cleaning urinary;
- a solution is simultaneously provided of a toilet capable of executing the cleaning of the floor surface, formed by said cover grate 13, tread on by a user when under conditions of use of the toilet;
- such a toilet is capable of performing the self-cleaning in response to a command of a user;
- such a toilet is capable of automatically performing the self-cleaning when associated with a control device;
- the cup-shaped body and also the second lower basin 12 may be kept horizontal and substantially level.

Those skilled in the art may make many changes and adaptations to the embodiments described above or can replace elements with others which are functionally equivalent in order to meet contingent needs without however departing from the scope of the appended claims.

LIST OF REFERENCES

1. Self-cleaning toilet or self-cleaning urinary
2. Lower cup-shaped portion of the toilet or lower cup-shaped body or cup-shaped portion
3. Emptying opening of the lower cup-shaped body
4. Filling opening of the lower cup-shaped body
5. Side wall of the lower cup-shaped body
6. Inner surface of the side wall
7. Upper edge of the side wall
7' Upper edge of the inner surface
7" Upper edge of the outer surface
8. Outer surface of the side wall
9. Gap
10. First basin or first tank
11. Box-like support
12. Second basin or second tank
13. Cover grate
14. Upper shield
15. Containment surface
16. Third basin or third tank
17. Third basin opening or third basin cleaning opening
18. Side or edge of the second basin
19. Upper edge of the shield
20. Assembly
21. Building wall
22. Tilt adjustment device
23. Sensor
24. Data processing unit
25. Operating device
26. Anterior portion or front portion of the lower cup-shaped body
27. Rear portion of the lower cup-shaped body
28. Valve
29. Septum
30. 31. Fluid supply duct
32. Draining pipe
32'. Second basin drain
33. Discharge mouth of the first basin or cleaning opening of the first basin
34. Second further outlet mouth of the first basin
35. First cup-shaped shell
36. Second cup-shaped shell
37. Bottom wall or transverse wall
38. Level of the floor 39. Bevel or channel
40. Second basin opening
41. Containing edge
F. Cleaning fluid for cleaning the inner surface
F'. Cleaning fluid for cleaning the outer surface

The invention claimed is:

1. A self-cleaning toilet comprising:

a lower cup-shaped body having cup shape, said lower cup-shaped body delimiting at least one emptying opening adapted to be connected to a draining pipe of the self-cleaning toilet, and at least one filling opening, opposite to said at least one emptying opening and adapted to face a user of the self-cleaning toilet, wherein:

said lower cup-shaped body comprises at least one side wall delimiting, with an upper edge thereof, at least one portion of said at least one filling opening;

said at least one side wall comprises an inner surface and an outer surface opposite to said inner surface with respect to said at least one side wall;

said at least one side wall at least partially delimits a gap interposed between said inner surface and outer surface, said gap forming at least one first basin adapted to contain a volume of cleaning fluid (F, F');

said at least one first basin leads to both said inner surface and said outer surface by at least one discharge mouth;

said at least one first basin is connected to an opening of a fluid supply duct adapted to convey a volume of cleaning fluid (F, F') into said at least one first basin so that when the cleaning fluid (F, F') received in said at least one first basin overflows, the cleaning fluid cleans both said inner surface and said outer surface of the lower cup-shaped body, and wherein said self-cleaning toilet further comprises at least one second basin comprising at least one second basin opening facing said outer surface of the at least one side wall of the lower cup-shaped body, said outer surface leading to said at least one second basin opening so that said at least one second basin is suppliable with the cleaning fluid (F') overflowed from said at least one first basin for cleaning the outer surface.

2. The self-cleaning toilet of claim 1, wherein said lower cup-shaped body has tapered shape.

3. The self-cleaning toilet of claim 1, wherein said inner surface and said outer surface of the at least one side wall are not parallel to each other.

4. The self-cleaning toilet of claim 1, wherein the at least one discharge mouth of said at least one first basin is half-moon shaped.

5. The self-cleaning toilet of claim 1, wherein:

said lower cup-shaped body comprises a front portion facing the user of the self-cleaning toilet under operating conditions, and an opposed rear portion, opposite to said front portion with respect to said at least one filling opening of the lower cup-shaped body;

said front portion completely delimits said gap, thus forming said at least one first basin which leads from the upper edge of the front portion; and wherein the at least one discharge mouth extends along a whole upper perimeter of the upper edge of the front portion of the lower cup-shaped body.

6. The self-cleaning toilet of claim 1, further comprising a box-like support supporting said lower cup-shaped body in position, said box-like support comprising a box-like body forming said at least one second basin and a cover grate forming a floor surface over the at least one second basin.

7. The self-cleaning toilet of claim 6, wherein said box-like support comprises a tilt adjustment device adapted to keep said lower cup-shaped body level.

8. The self-cleaning toilet of claim 1, wherein said at least one second basin opening is at least partially delimited by said outer surface of the at least one side wall of the lower cup-shaped body.

9. The self-cleaning toilet of claim 1, further comprising an upper shield comprising a containing wall adapted to face the user of the self-cleaning toilet, wherein said upper shield comprises a third basin that leads to said containing wall by at least one third basin opening so that said containing wall is adapted to convey the cleaning fluid overflowing from said third basin to said lower cup-shaped body of the self-cleaning toilet to clean at least the inner surface of the rear portion of the at least one side wall of the lower cup-shaped body.

10. The self-cleaning toilet of claim 1, wherein said self-cleaning toilet is made of metal, comprising crude or satin stainless steel.

11. The self-cleaning toilet of claim 1, comprising a control and operating device comprising at least one presence sensor, a data processing unit and at least one operating device, wherein said at least one presence sensor is adapted to detect information on presence or absence of the user of the self-cleaning toilet and to transfer detected information to said data processing unit, and wherein said data processing unit acts in conjunction with said at least one operating device to allow the cleaning fluid (F, F') to flow from the supply duct to the at least one first basin and fill it.

12. The self-cleaning toilet of claim 1, wherein said at least one side wall of said lower cup-shaped body comprises two cup-shaped shells fitted onto each other so that a first cup-shaped shell forms the inner surface and a second cup-shaped shell forms the outer surface, and so that said gap forming said at least one first basin is interposed between said first cup-shaped shell and said second cup-shaped shell, said gap being adapted to contain a volume of cleaning fluid (F, F').

13. The self-cleaning toilet of claim 1, wherein said lower cup-shaped body is formed by at least one shaped sheet, which is rolled and welded in edge portions thereof to form a lower cup-shaped body that is frustoconical shaped.

14. The self-cleaning toilet of claim 1, wherein said at least one side wall comprises a partition septum interposed between the outer surface and the inner surface of the at least one side wall of the lower cup-shaped body, said septum acting as divide for the cleaning fluid (F, F') overflowing from said at least one first basin so that said septum defines two discharge mouths for discharging the cleaning fluid (F, F') from the at least one first basin.

15. An assembly of modular units for public washroom comprising a plurality of self-cleaning toilets according to claim 1.

16. The self-cleaning toilet of claim 1, wherein said lower cup-shaped body has frustoconical shape.

17. The self-cleaning toilet of claim 1, wherein said at least one second basin opening is arranged under said outer surface of the at least one side wall of the lower cup-shaped body.

18. The self-cleaning toilet of claim 1, wherein said self-cleaning toilet is a men's urinal.

19. The self-cleaning toilet of claim 1, wherein the at least one side wall of said lower cup-shaped body is formed by at least two shaped sheets, which are rolled and welded in respective edge portions thereof to form at least two cup-shaped shells, frustoconical shaped, thus interposing a gap between said two cup-shaped shells to form said at least one first basin.

* * * * *